US008544140B2

(12) United States Patent
Shinler et al.

(10) Patent No.: US 8,544,140 B2
(45) Date of Patent: Oct. 1, 2013

(54) QUICK LOCK SQUEEGEE ATTACHMENT AND METHOD OF USE

(75) Inventors: Kevin L. Shinler, North Branch, MN (US); John C. Ickes, Rockford, MN (US); Steven V. Feeny, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 332 days.

(21) Appl. No.: 12/942,219

(22) Filed: Nov. 9, 2010

(65) Prior Publication Data

US 2011/0107540 A1 May 12, 2011

Related U.S. Application Data

(60) Provisional application No. 61/259,428, filed on Nov. 9, 2009.

(51) Int. Cl.
*A47L 11/00* (2006.01)

(52) U.S. Cl.
USPC ..... 15/250.48; 15/250.46; 15/250.47; 15/49.1; 15/97.1; 15/401; 403/221; 403/223; 403/229

(58) Field of Classification Search
USPC ..... 15/49.1, 51, 96, 401, 250.46–250.48, 15/97.1; 403/221, 223, 229
IPC ..... A47L 11/00
See application file for complete search history.

(56) References Cited

U.S. PATENT DOCUMENTS

| | | | |
|---|---|---|---|
| 3,024,485 | A | 3/1962 | Schmidt et al. |
| 3,316,578 | A | 5/1967 | Tamny |
| 3,685,085 | A | 8/1972 | Jaffa |
| 4,363,152 | A | 12/1982 | Karpanty |
| 5,455,985 | A | 10/1995 | Hamline et al. |
| 5,483,718 | A | 1/1996 | Blehert et al. |
| 5,720,890 | A | 2/1998 | Caliva |
| 5,802,665 | A | 9/1998 | Knowlton et al. |
| 6,602,018 | B2 | 8/2003 | Feeny et al. |

FOREIGN PATENT DOCUMENTS

WO 2007076181 A2 7/2007

OTHER PUBLICATIONS

International Search Report and Written Opinion for PCT/US2010/056003, mailed Jan. 10, 2011.
International Search Report and Written Opinion mailed Jun. 13, 2011 for PCT/US2010/055923.

*Primary Examiner* — David Redding
(74) *Attorney, Agent, or Firm* — Briggs and Morgan, P.A.; John F. Klos

(57) ABSTRACT

A releasable squeegee assembly for coupling to a surface maintenance machine and including a compliant bushing and an over-center lever attached to a pull rod and compliant spring. The compliant bushing is compressed via said over-center lever with said compliant spring providing a spring force. A bushing sleeve is provided to limit the degree of compression of said compliant bushing by the over-center lever. A method of coupling a squeegee assembly to a surface maintenance machine is also provided.

20 Claims, 17 Drawing Sheets

QUICK LOCK SQUEEGEE ATTACHMENT AND METHOD OF USE

RELATED APPLICATIONS

This application claims the benefit of U.S. Provisional Application No. 61/259,428, filed Nov. 9, 2009, and incorporated herein by reference.

FIELD OF THE INVENTION

The present invention generally relates to surface cleaning equipment. More particularly the present invention relates to a squeegee assembly having a novel attachment and non-destructive release mechanism for use with such equipment.

BACKGROUND OF THE INVENTION

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a squeegee assembly for removing solution from a floor which has been cleaned by application of a cleaning solution of water and a detergent in conjunction with scrubbing action of one or more moving brushes. Accordingly, the squeegee assembly of such prior art cleaning vehicles often mounts at or near the rear of the surface maintenance vehicle to direct the solution to a removal location where the solution (including suspended dirt, particles and contaminants) is removed. The cleaning solution is typically supplied to the floor surface through or near rotary scrub brushes operating from a lower portion of the vehicle. The squeegee assembly may include a squeegee supporting member of generally arcuate configuration with two squeegee blades spaced apart and affixed to the supporting member to promote consistent contact with the surface to be cleaned and wiped.

In some prior art cleaning vehicles having two squeegee blades, a vacuum source may couple to the wiping assembly to lift the loaded cleaning solution from the space between the blades to a remote reservoir or other collection unit. The squeegee assembly is often sufficiently wide to at least fully cover the path width of the scrub brushes and/or the wheels of the cleaning vehicle. Consequently, at least the ends of the squeegee assembly tend to be exposed at the sides of the vehicle and are therefore potentially very vulnerable to contact with stationary objects which might be encountered during operation of the vehicle during cleaning operations and when transporting the vehicle between cleaning operations. Solid contact between an end of a squeegee assembly and a stationary object such as, for example, a vertical support column, can result in substantial and costly damage to not only the squeegee assembly but also the surface maintenance vehicle itself resulting in downtime, costly repair and/or replacement of all or a part of the vehicle (as well as the stationary object) and in some circumstances causing damage or injury to the human operator of the vehicle as well.

U.S. Pat. No. 6,602,018, to Feeny et al., entitled "Squeegee Assembly Having a Non-Destructive Release Mode", is incorporated by reference herein. Prior art squeegee assembly couplings use a compliant bushing that has a portion of the bushing captured by the squeegee assembly and the remainder of the bushing captured in the squeegee suspension. A threaded fastener is used to secure the bushing between the squeegee assembly and the squeegee suspension. The pocket profile in the squeegee suspension allows for the through hardware to be released through an open ended slot profile and also incorporates a pocket for the portion of the compliant bushing. The through hardware will hold the assembly together for normal operation. When the squeegee assembly strikes a rigid/semi-rigid object the bushing exits the open slot so as to free the squeegee assembly from the squeegee suspension.

The threaded hardware of the prior art is difficult and time-consuming to work with, and is a burden to work with as it is located in a dirty environment and the threads become contaminated. Thus, there is a need for an improved releasable coupling for a squeegee assembly which has improved features.

SUMMARY OF THE INVENTION

The present invention teaches, enables and discloses an improved mechanical coupling for a squeegee assembly usable in a surface maintenance vehicle. Such a vehicle includes those self-powered and manually powered cleaning vehicles applied to the task of removing loaded cleaning solution from a cleaned surface and preferably include all such vehicles using a squeegee assembly; although rigid or fixed wiper assemblies for such vehicles benefit from the teaching of this disclosure. Such a surface may comprise an interior or exterior floor having some limited porosity but preferably comprising finished concrete (whether painted or sealed), asphalt, ceramic tile, resin-based tile, and the like and including most types of flooring typical of commercial and industrial-grade facilities. However, the teaching hereof finds application in diverse handling of fluids, whether or not "loaded," naturally-occurring liquid(s) or pure cleaning fluid.

Accordingly, the releasable coupling for a squeegee assembly of the present invention tolerates a wide variety of stresses imparted to the blade portions of a squeegee assembly during wiping operations and before becoming disconnected from a surface maintenance vehicle to which it is coupled. In most embodiments of the present invention, the squeegee assembly is coupled to a suspension mount coupled to the maintenance vehicle and typically designed to permit the squeegee assembly to articulate, or "float," thereby maintaining contact between one or more wiper blades secured to the squeegee assembly and a portion of the surface to be cleaned during operation of the surface maintenance vehicle. A squeegee assembly utilizing the teaching of the present invention thus may be raised, lowered, pivoted and/or rotated either passively using gravity or manually using gearing, cables and the like and/or via internal combustion, electric, pneumatic, hydraulic or other motive means.

While not required to practice the present invention, in one preferred embodiment of the present invention at least two squeegee blades are both secured to a vacuum core which forms a substantially sealed chamber when biased toward the surface to be cleaned. A source of vacuum is applied to a port formed in a side of the sealed chamber to evacuate the loaded liquid and the like from the sealed chamber to a storage vessel or reservoir in anticipation of later disposal.

During cleaning operations, as the maintenance vehicle is propelled forward over a portion of a surface to be cleaned, when the squeegee assembly contacts a relatively stationary object, or otherwise becomes subject to instantaneous or very rapidly increasing resistance to forward movement, the improved mechanical coupling for the squeegee assembly initially absorbs some of the stresses imparted to the squeegee assembly. Typically, portions of each improved mechanical coupling designed to absorb the stress forces will deform most nearest the location of increasing resistance to forward movement, and may either become fully disconnected if the stress force reaches a threshold force value or recoil to the original mounting location after absorbing forces that are less than said threshold force value. The threshold value force at which a squeegee assembly dislodges from its mounting location is designed to avoid damage to the squeegee assembly, the mounting member (if any), and the maintenance vehicle itself. The threshold force value may vary but due to the design of the improved mechanical coupling of the present invention, said threshold force value should have a substantially similar magnitude independent of the axial compressive force applied each time the mechanical coupling attaches a squeegee assembly to a maintenance vehicle.

In a preferred form, the improved mechanical coupling comprises a resilient compliant bushing, capable of absorbing stress primarily in a horizontal plane opposing to a forward direction of travel for the maintenance vehicle. The compliant bushing is preferably cylinder-shaped having a substantially common-radius central aperture, or passageway, and an enlarged head feature having an increased outer radius on one end thereof.

In addition, in combination with the compliant bushing (and biasing feature for ease of mounting and remounting same) a substantially non-deformable central sleeve member resides within a common-radius central aperture thereof to limit the deformation of the compliant bushing, thereby functioning as a mechanical "travel stop" feature, and thus creating a fairly uniform and limited range of compressive force for the entire assembly when operatively coupled to a maintenance vehicle. Of course, a variety of different components may be substituted for the central sleeve member as a travel stop. Thus, the compliant bushing may include a relatively rigid stop element, such as a sleeve member formed of material designed to withstand deformation in an axial direction, through which an actuation rod is received during assembly. The sleeve may be metal and operatively limit the degree of deformation of the compliant bushing during assembly and reinstallation subsequent to detachment of the squeegee assembly during operation.

In a most preferred embodiment, mechanical biasing of the deformable member is provided by a biasing structure inserted into the interior of the central sleeve member designed to support the deformable member in a desired pre-mount configuration. The mechanical biasing includes an actuation rod attached to an over-center lever and to a resilient spring and retainer at an opposite end.

The suspension mount preferably comprises a set of two open-ended discrete collar-shaped, or generally semi-circular, mounts having an open channel formed opposite the direction of travel of the maintenance vehicle. The open-ended mounts may be ovoid, toroidal, annular, or even rectangular-shaped mounts, and the like as long as the open channel, or spacing, is provided therein so that the compliant bushing may exit thereof when a threshold value force impacts the squeegee assembly.

Similarly the squeegee assembly frame preferably comprises a set of two open-ended discrete collar-shaped, or generally semi-circular, mounts having an open channel formed opposite the direction of travel of the maintenance vehicle. The open-ended mounts may be ovoid, toroidal, annular, or even rectangular-shaped mounts, and the like as long as the open channel, or spacing, is provided therein so that the compliant bushing may exit thereof when a threshold value force impacts the squeegee assembly In general, the improved mechanical coupling of the present invention comprises subcomponents shaped to cooperate with other subcomponents and not limited to type of motive force applied although all elements of the improved mechanical coupling are preferably tightened, and loosened, manually.

One object of the invention is to provide a squeegee assembly for a surface maintenance vehicle which is tolerant of stress forces imparted to the squeegee assembly and designed to progressively begin to separate from the vehicle as cumulative stresses upon the squeegee assembly from a physical obstacle, such as a stationary object, grow toward a threshold force value.

Another object of the present invention is to provide a squeegee assembly for a surface maintenance vehicle which is releasably connected to the vehicle via one or more compliant bushings having a pre-selected release mode intended to preserve in good working order the components of the squeegee assembly, the surface maintenance vehicle, and the physical obstacle encountered by the squeegee assembly as well as the operator of the vehicle.

Another object of the present invention is to teach, enable and disclose a class of mechanical coupling assemblies useable for connecting a squeegee assembly to a surface maintenance vehicle having a predetermined release force threshold which is generally the same for each of a plurality of such coupling assemblies and is substantially independent of the degree of compressive stress imparted to the mechanical coupling when first connected.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
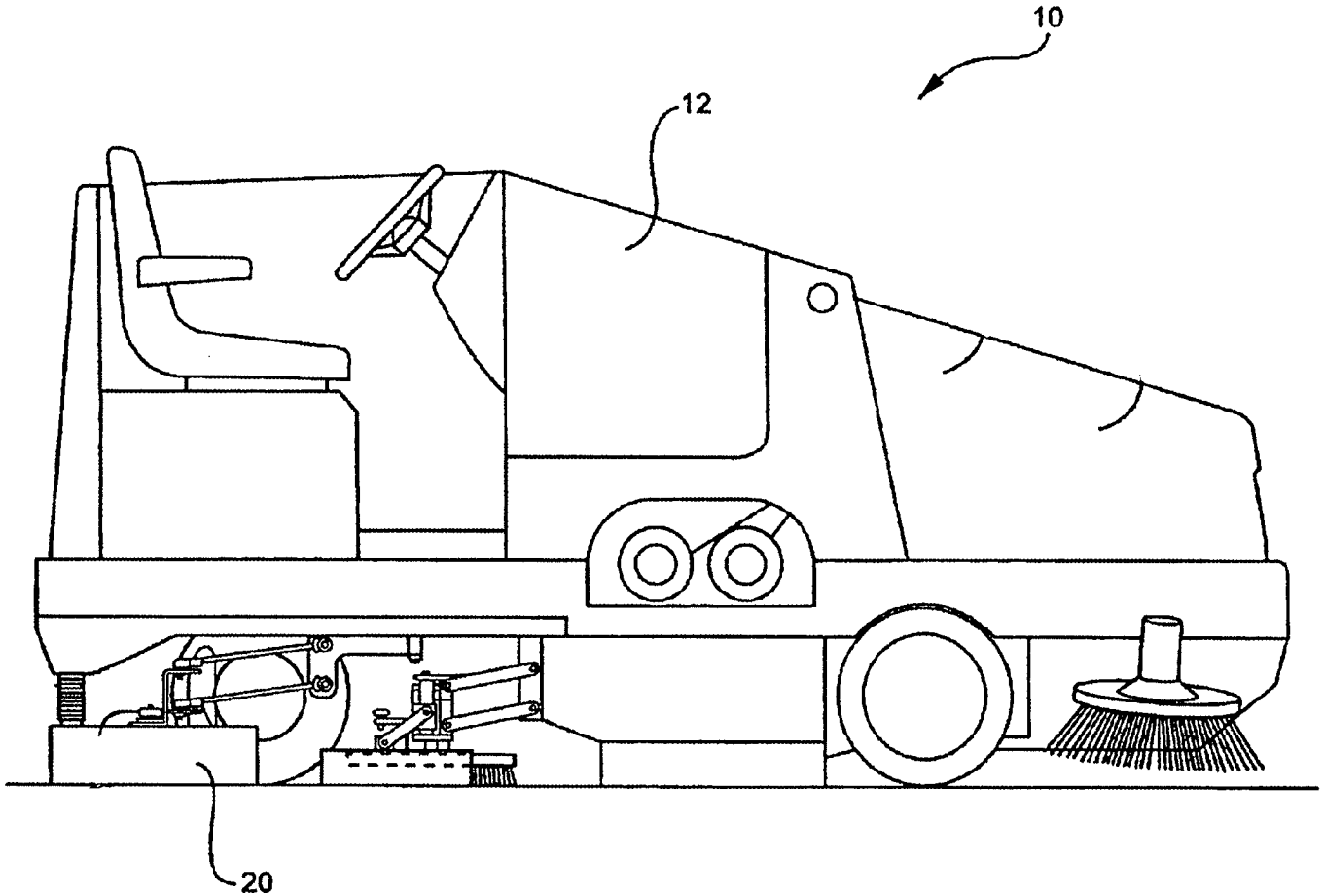
FIG. 1 is a depiction of a ride-on type surface maintenance machine utilizing a squeegee assembly of the present invention.
Figure 2:
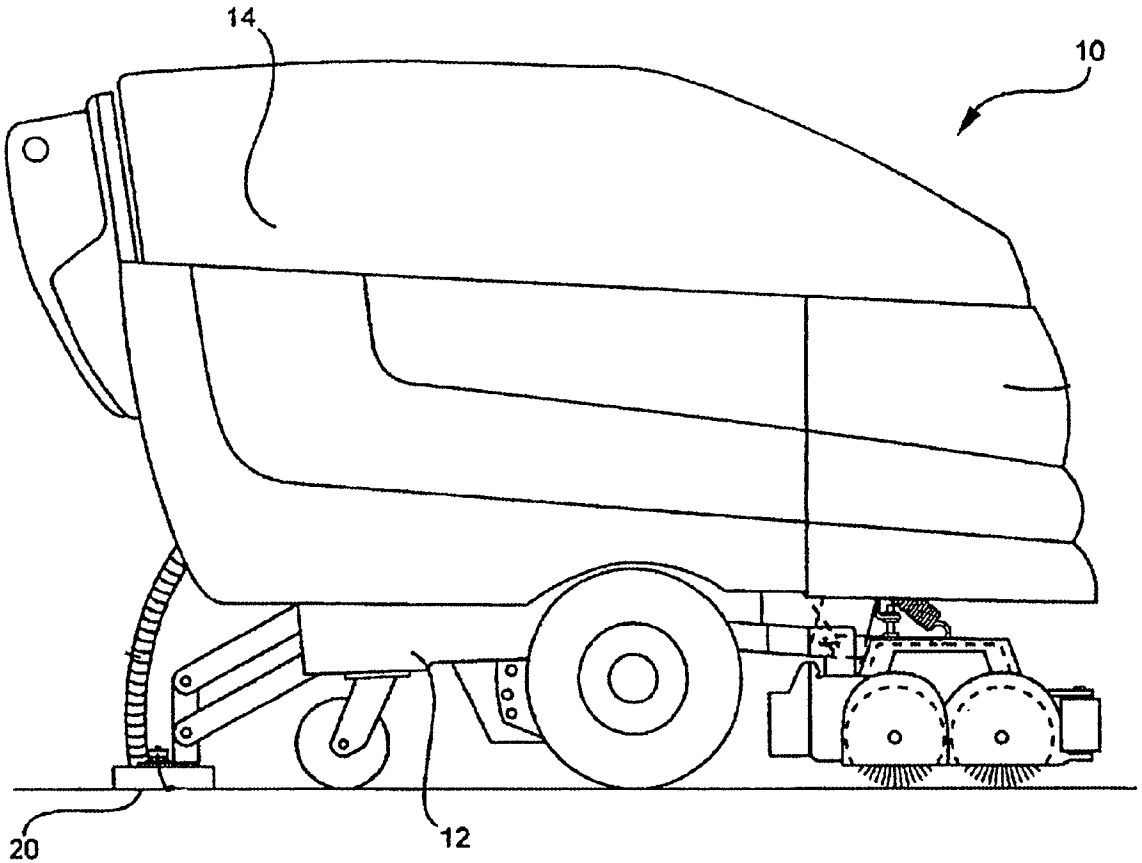
FIG. 2 is a depiction of a walk-behind type surface maintenance machine utilizing a squeegee assembly of the present invention.
Figure 3:
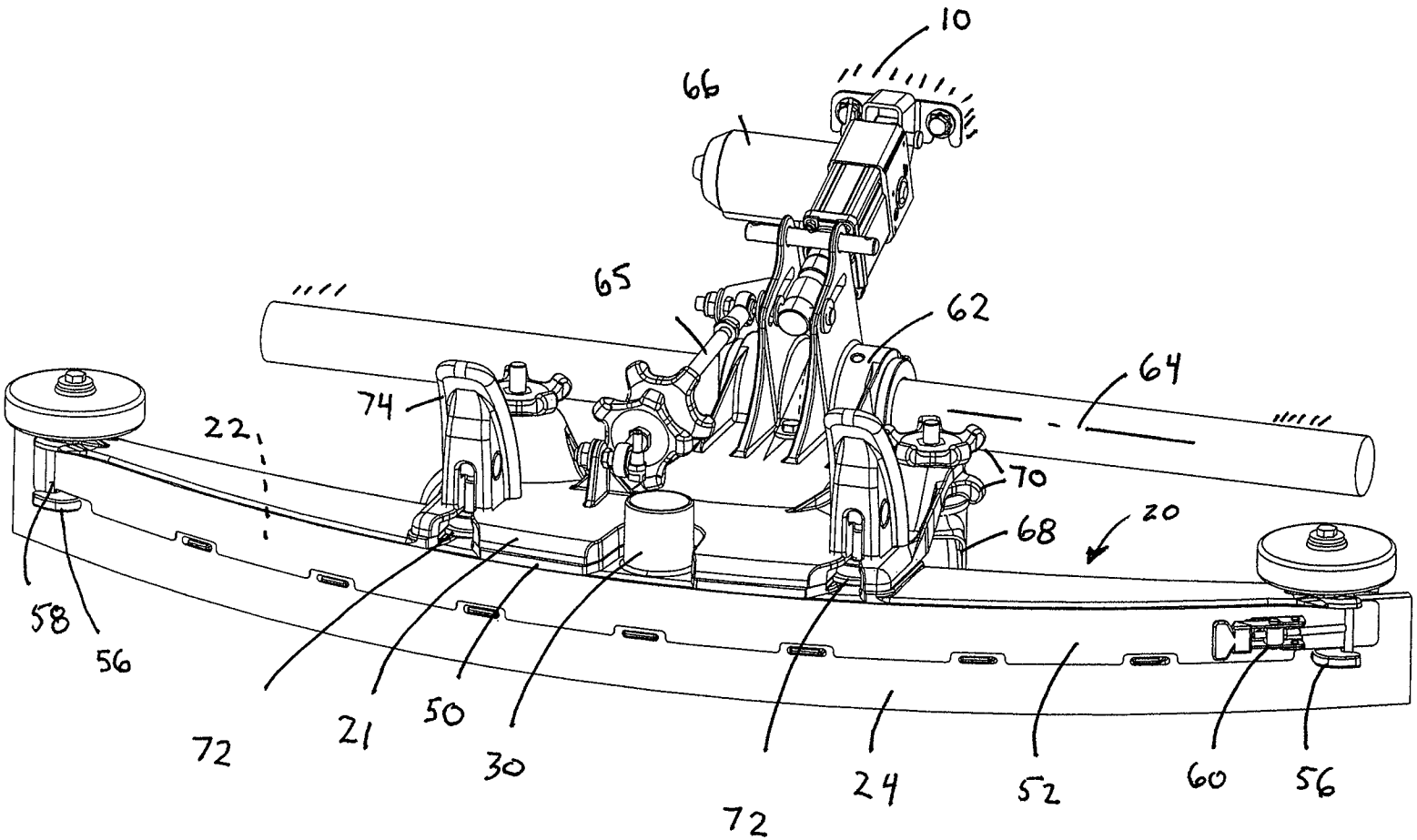
FIG. 3 illustrates an embodiment of the squeegee assembly of the present invention.
Figure 4:
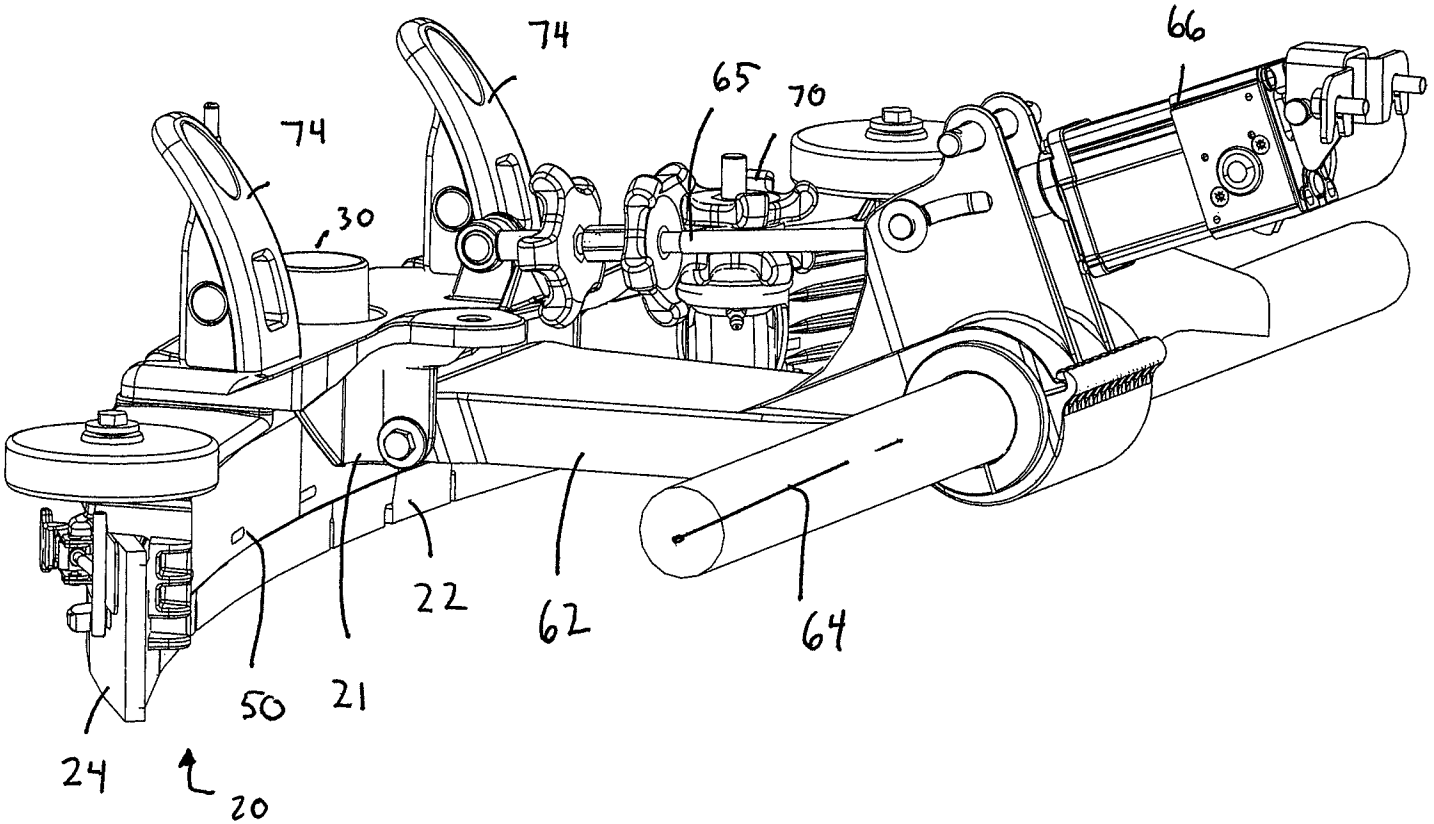
FIGS. 4-7 illustrate various perspective views of the squeegee assembly of FIG. 3.

Industrial sweeper-scrubbers which may use the present invention are shown in FIGS. 1 and 2. These surface maintenance machines may be used for sweeping and/or scrubbing floors in factories, warehouses, and other industrial or commercial establishments. As shown in FIG. 1, a riding-type surface maintenance vehicle 10 has a frame 12, and is supported on a plurality of front and rear wheels. Typically, such a surface maintenance vehicle 10 includes a variety of implements such as brushes and systems for dispensing cleaning solutions typically composed of detergent and water which suspend dirt. Herein, a cleaning solution containing suspended dirt and other particles shall be called a "loaded cleaning solution." Loaded cleaning solution and other liquid material are usually removed by a squeegee assembly 20. Squeegee assembly 20 is often mechanically coupled near the rear of a surface maintenance vehicle 10. Such a squeegee assembly 20 is operatively connected to the surface maintenance vehicle 10 by a releasable attachment device as further described in more detail herein. One example of such a ride-on surface maintenance vehicle is disclosed in U.S. Pat. No. 5,455,985, assigned to Tennant Company, the assignee herein, and incorporated herein by reference in its entirety.

FIG. 2 illustrates a walk-behind surface maintenance vehicle, such as a floor scrubbing vehicle disclosed in U.S. Pat. No. 5,483,718, assigned to Tennant Company, the assignee herein, and incorporated herein by reference in its entirety. As with the above-mentioned riding-type surface maintenance vehicle, the walk-behind surface maintenance vehicle 10 includes a variety of implements such as brushes and is capable of applying cleaning solutions. Again, loaded cleaning solution and other liquid material are usually removed by a squeegee assembly 20 located at the rear of the surface maintenance vehicle 10. And again, such a squeegee assembly 20 is operatively connected to the surface maintenance vehicle 10 by a releasable attachment device as described in more detail herein.

The present invention is concerned with releasably securing the squeegee assembly 20 to these types of vehicles, and not the sweeping or other functional aspects of the vehicles. The particular surface maintenance vehicles illustrated in FIGS. 1 and 2 are thus relevant insofar as depicting the preferred environment with which the present invention is concerned.

Referring to FIGS. 3-7, one embodiment of a squeegee assembly 20 is operatively and releasably connected to the frame of a surface maintenance machine 10 by a non-destructive releasable attachment device as described herein. The squeegee attachment device couples the squeegee assembly 20 to a squeegee suspension mount 21 which is operatively connected to the surface maintenance vehicle 10 for vertical movement in order to raise and lower the squeegee assembly during cleaning operations and transport. Vertical movement of the squeegee assembly 20 may be accomplished via a variety of well known approaches such as hydraulic, pneumatic, electric, spring-biased, manually driven cables and/or gearing and the like (not shown). Suspension mount 21 may also "float" relative to the vehicle to enable the squeegee assembly 20 to remain in contact with surfaces being cleaned, even though they are somewhat irregular or uneven. Additional elements of the attachment device are disclosed herein.

Squeegee assembly 20 includes front and rear flexible blades 22, 24 mounted to a vacuum core structure 26 so that blades 22, 24 are spaced at the center and taper towards each other so that the ends are closely adjacent and/or tight against each other in the preferred form shown. The front blade 22 has notches or slots in the free edge along its length to allow solution to pass therethrough. Blades 22 and 24 contact the floor surface. Blades 22 and 24 are made from suitable material such as gum rubber, neoprene, urethane, or the like. A suction tube 30 is provided in vacuum core structure 26 in fluid communication between blades 22 and 24 adjacent the centers thereof and to which a vacuum can be supplied such that air and solution are pulled in through the slots in the front blade 22 or pulled from underneath the front blade 22 and flow out of tube 30, with the rear blade 24 acting as a wiper to leave the floor surface dry. Suction tube 30 is in fluid communication with a recovery tank in turn in fluid communication with a vacuum assembly which draws air from the hollow interior of the recovery tank. An example of a squeegee assembly is disclosed in U.S. Provisional Patent Application No. 61/259,421, filed Nov. 9, 2009, which is incorporated herein by reference in its entirety.

In the preferred form shown, blade 24 has a thickness less than blade 22 but could have equal thickness or different relative thicknesses according to the particular material from which blades 22 and 24 are formed. Likewise, in an unflexed and vertical position, blade 24 has a lower extent elevated above the lower extent of blade 22 in the form shown. In a preferred form, blades 22 and 24 are reversible so that both elongated edges can be oriented to be the lower wiping edges.

Front blade 22, rear blade 24 and vacuum core 26 are held against frame 50 via clamp band 52. Frame 50 includes clamp band engaging hooks 56 near ends of frame 50. Clamp band 52 includes a stationary latch 58 on one end and a movable latch 60 on the other end. Movable latch 60 is selectively manipulated to secure clamp band 52 to frame 50.

In one preferred form, squeegee assembly 20 is releasably coupled to squeegee mount 21. Squeegee mount 21 is connected to a pivot mount 62 which is adapted to pivot about an axis 64. The angular orientation of squeegee mount 21 relative to pivot mount 62 can be adjusted by changing the length of adjustment rod 65 and/or changing the height of adjustable caster wheels 68 using knobs 70. The angular orientation of pivot mount 62 relative to the machine 10 can be adjusted via electric actuator 66 using known control devices. Caster wheels 68 support the squeegee assembly 20 as the machine traverses a floor surface. One of the caster wheels 68 and knobs 70 are removed from FIG. 4.

Squeegee assembly 20 is releasably connected to squeegee mount 21. That is, upon contact with a substantial object, the squeegee assembly 20 is designed to break away from the squeegee mount 21. As described herein, a pair of compliant bushings 72 are used to releasably couple the frame 50 of squeegee assembly 20 to the squeegee mount 21. The compliant bushings 72 are held between the squeegee frame 50 and squeegee mount 21 at the coupling receiving areas by over-center levers 74, which preferably may be tightened or loosened by hand. Over center levers 74 are designed on the principle of variable mechanical advantage, and therefore, variable hand effort. During the initial movement of the lever from the "off" to the "on" position, there is great linear movement compared to the output effort. As the lever approaches the "on" position, the output effort becomes greater in comparison to the linear movement. As the lever passes over center, or toggle position, the mechanical advantage is greatest. Levers 74 with over-center toggle action keep the squeegee assembly secured to the surface maintenance machine, and prevent accidental opening due to shock or vibration. Levers 74 include long handles for comfortable grip.

Figure 5:
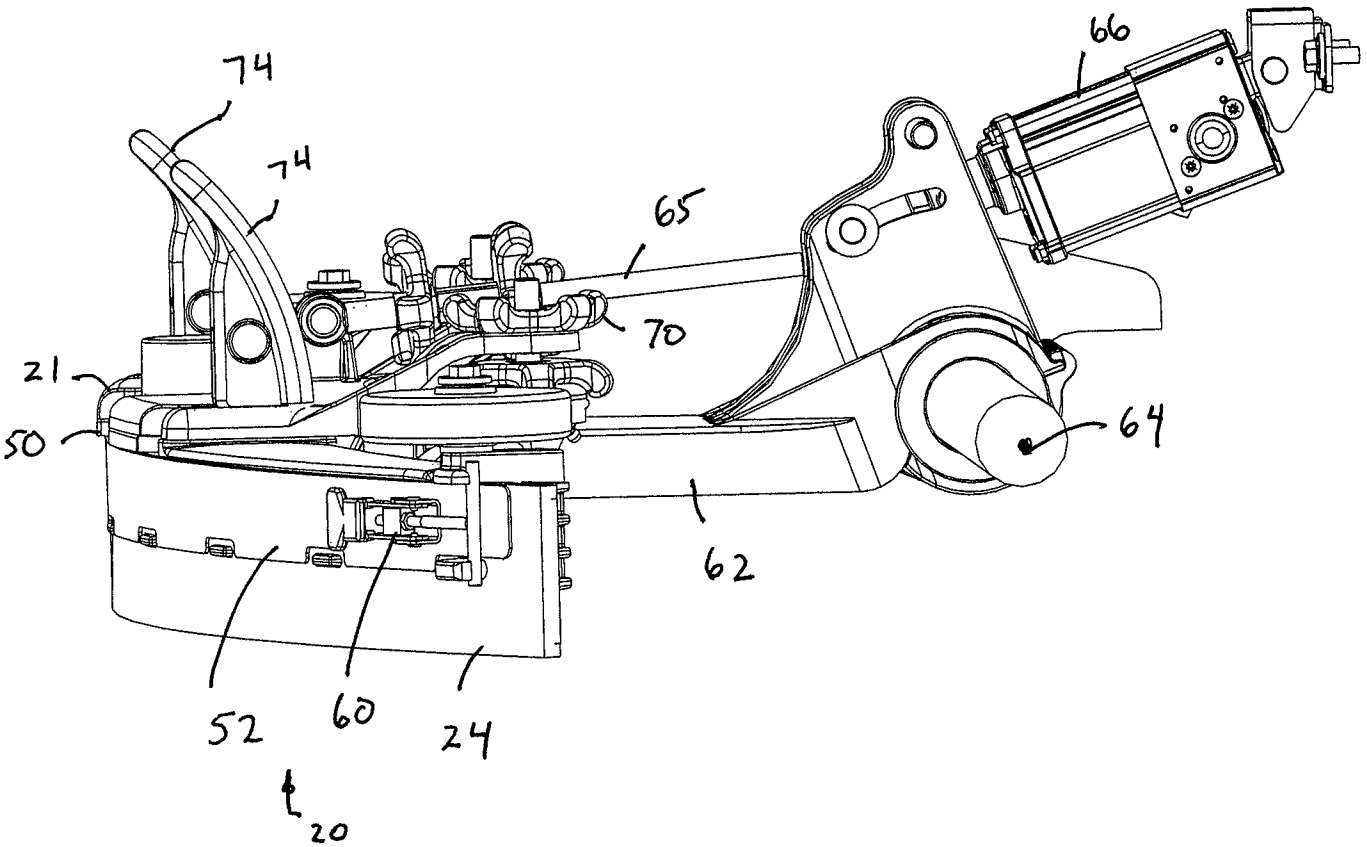
Figure 6:
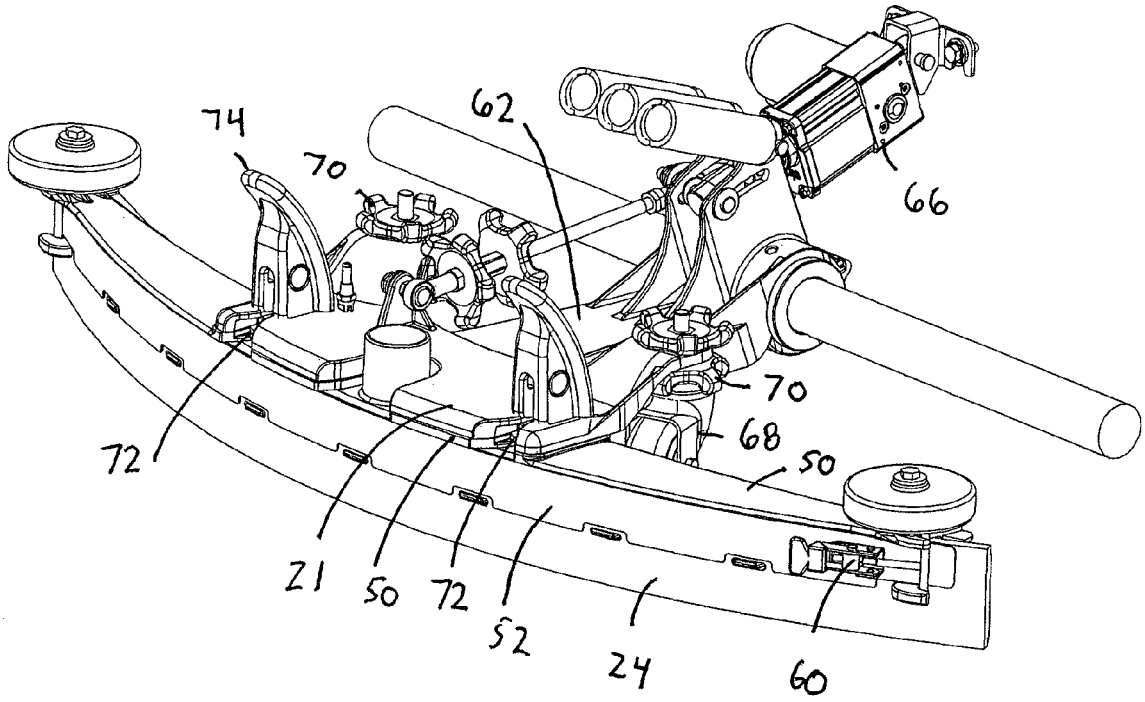

FIGS. 5-6 are side perspective views of the squeegee assembly 20 as attached to pivot mount 62.

Figure 7:
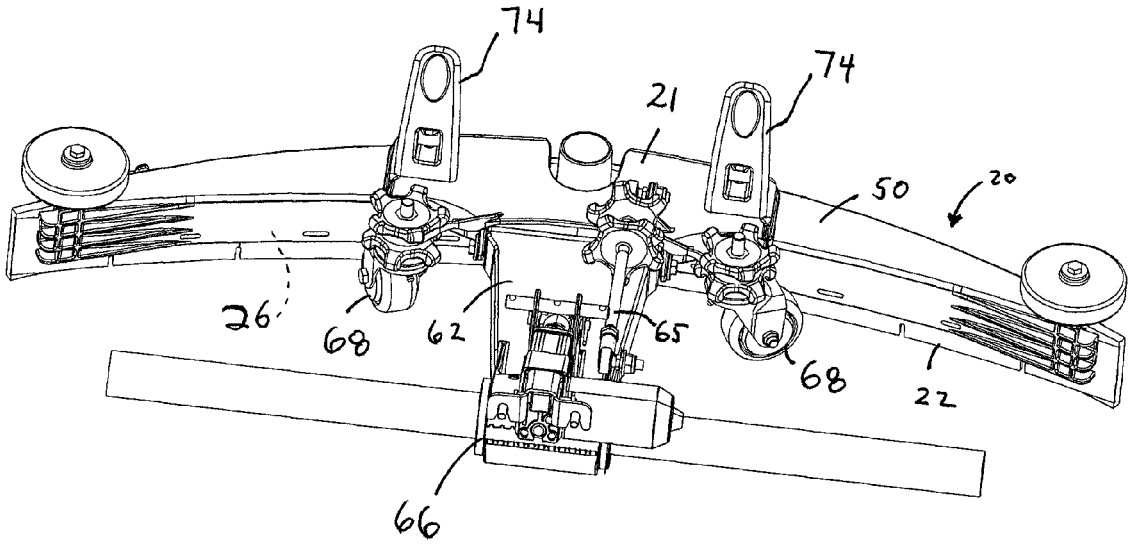

FIG. 7 is a top perspective view of the squeegee assembly 20 as attached to pivot mount 62.

Figure 8:
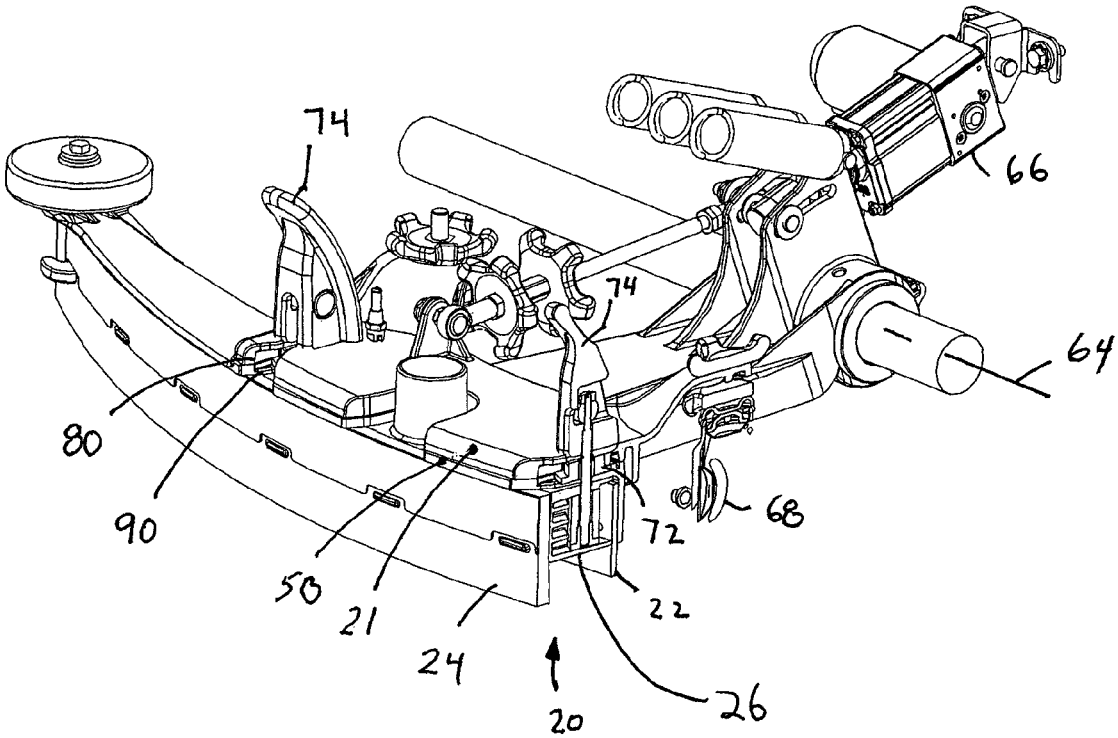
FIG. 8 is a cross-sectional view of the squeegee assembly of FIG. 3.

FIG. 8 is a cross-sectional view of the squeegee assembly 20, squeegee mount 21 and pivot mount 62. In a squeegee assembly release operation, the compliant bushings 72 pass out of coupling receiving areas 80, 90. Compliant bushings 72 are adapted to be received within coupling receiving area 80 of squeegee mount 21 and coupling receiving area 90 of frame 50.

Figure 9:
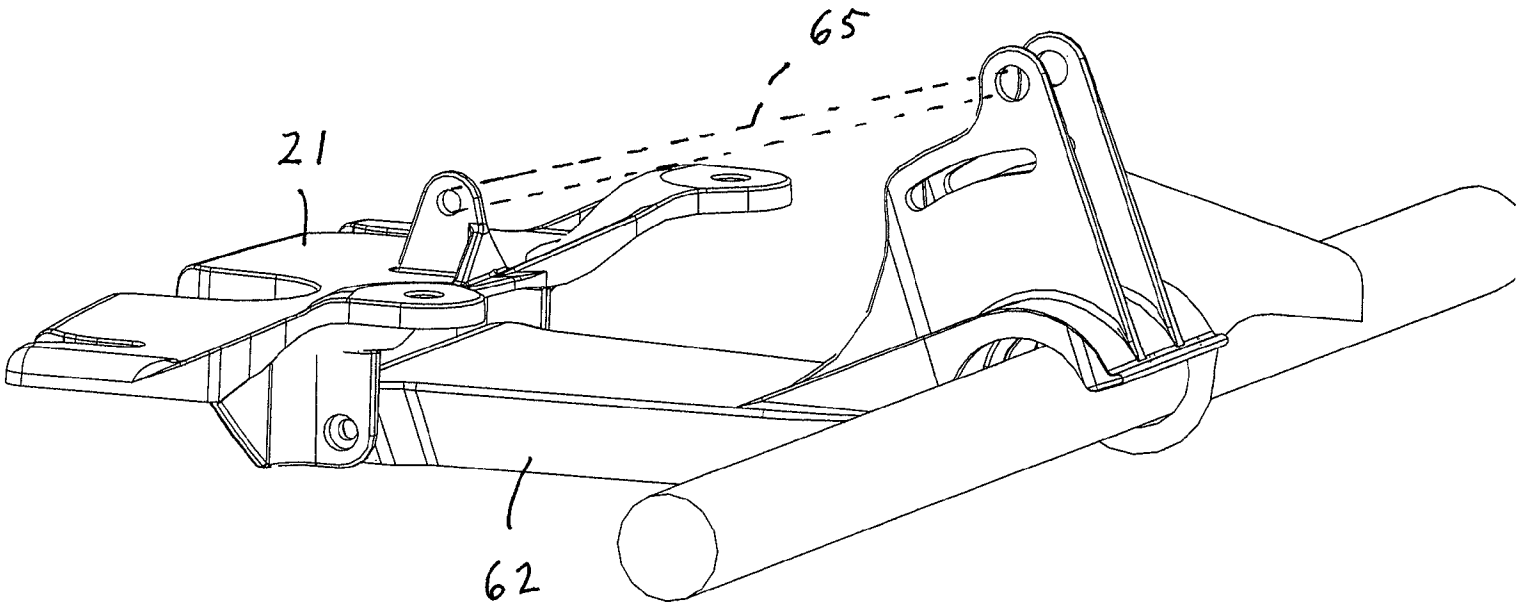
FIG. 9 is a perspective view of the squeegee mount and suspension structure of the squeegee assembly of FIG. 3.

FIG. 9 is a perspective illustration of the squeegee mount 21 as coupled to pivot mount 62.

Figure 10:
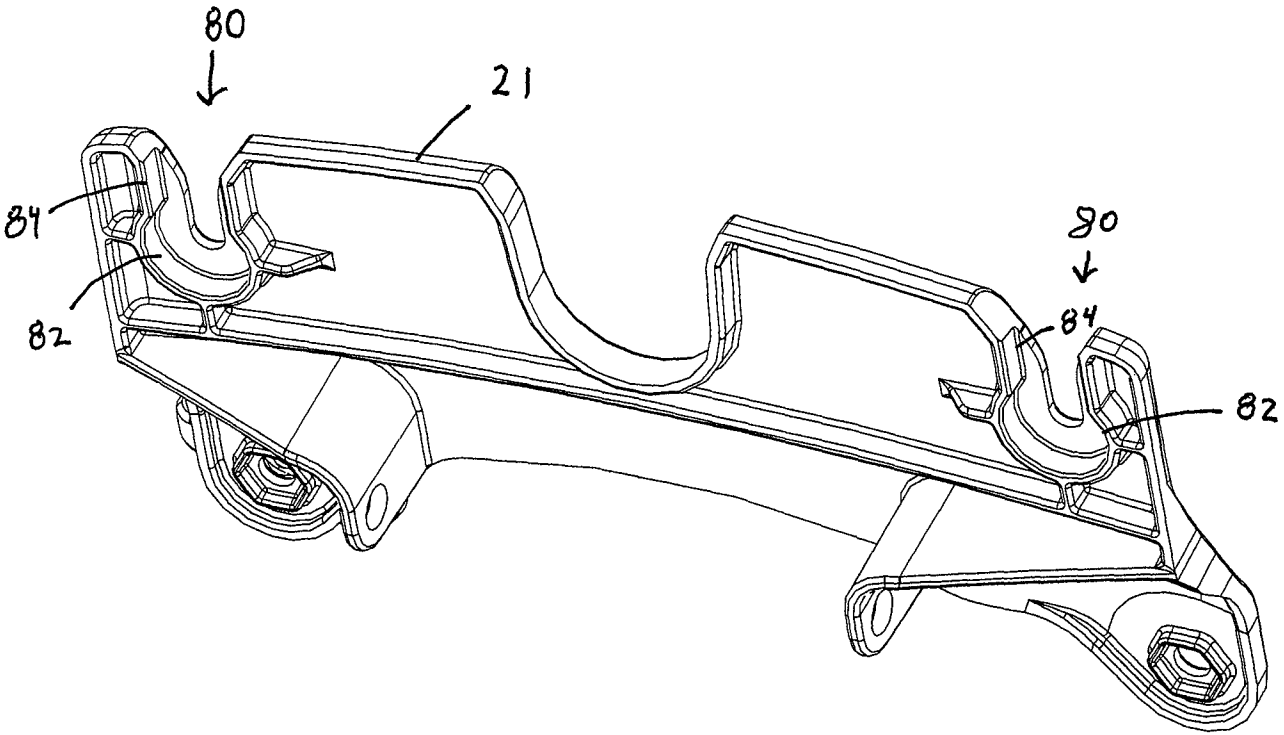
FIG. 10 is a perspective view of a squeegee mount of the squeegee assembly of FIG. 3.
Figure 11:
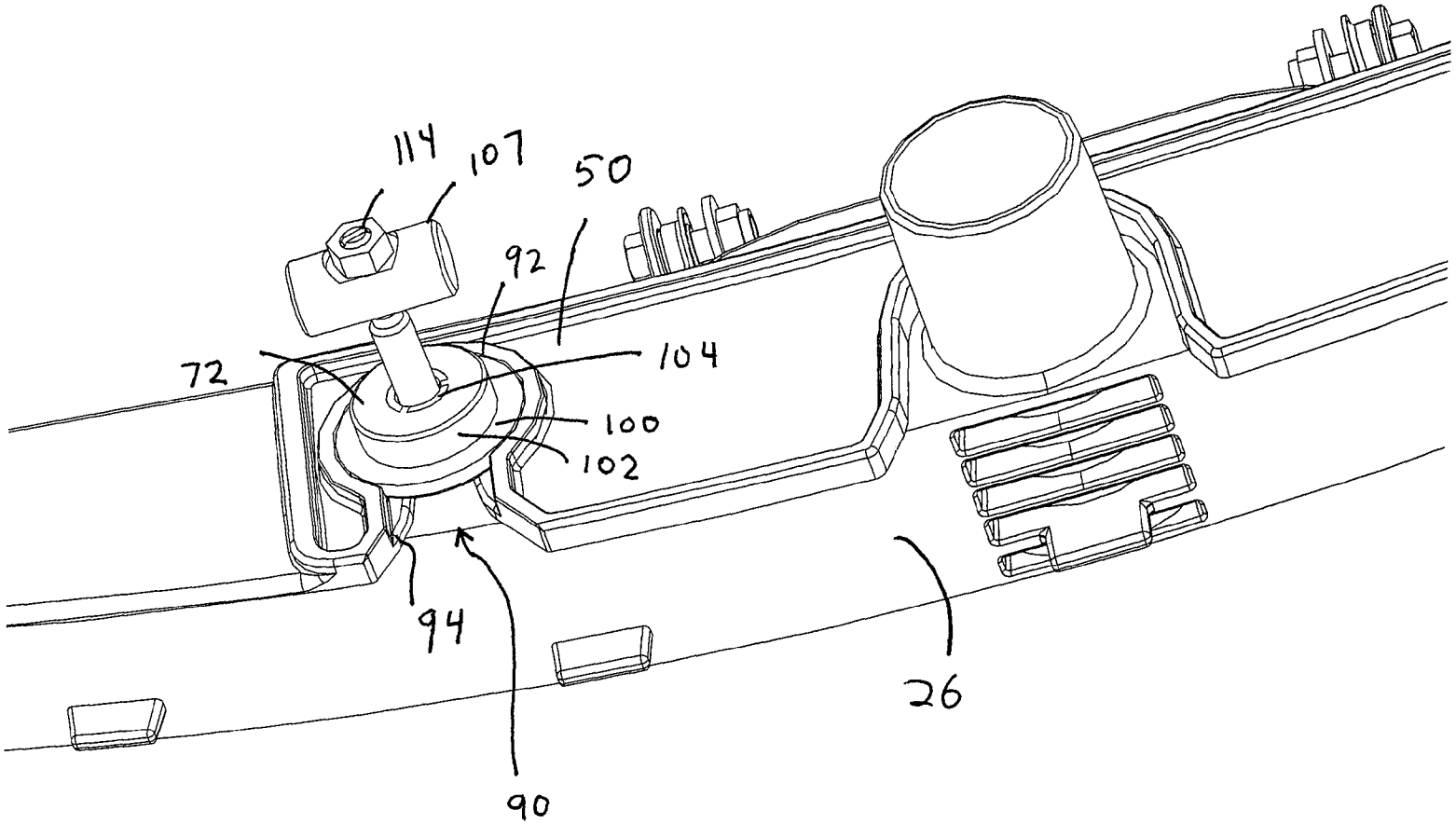
FIG. 11 is a perspective view of a portion of the squeegee assembly of FIG. 3.
Figure 12:
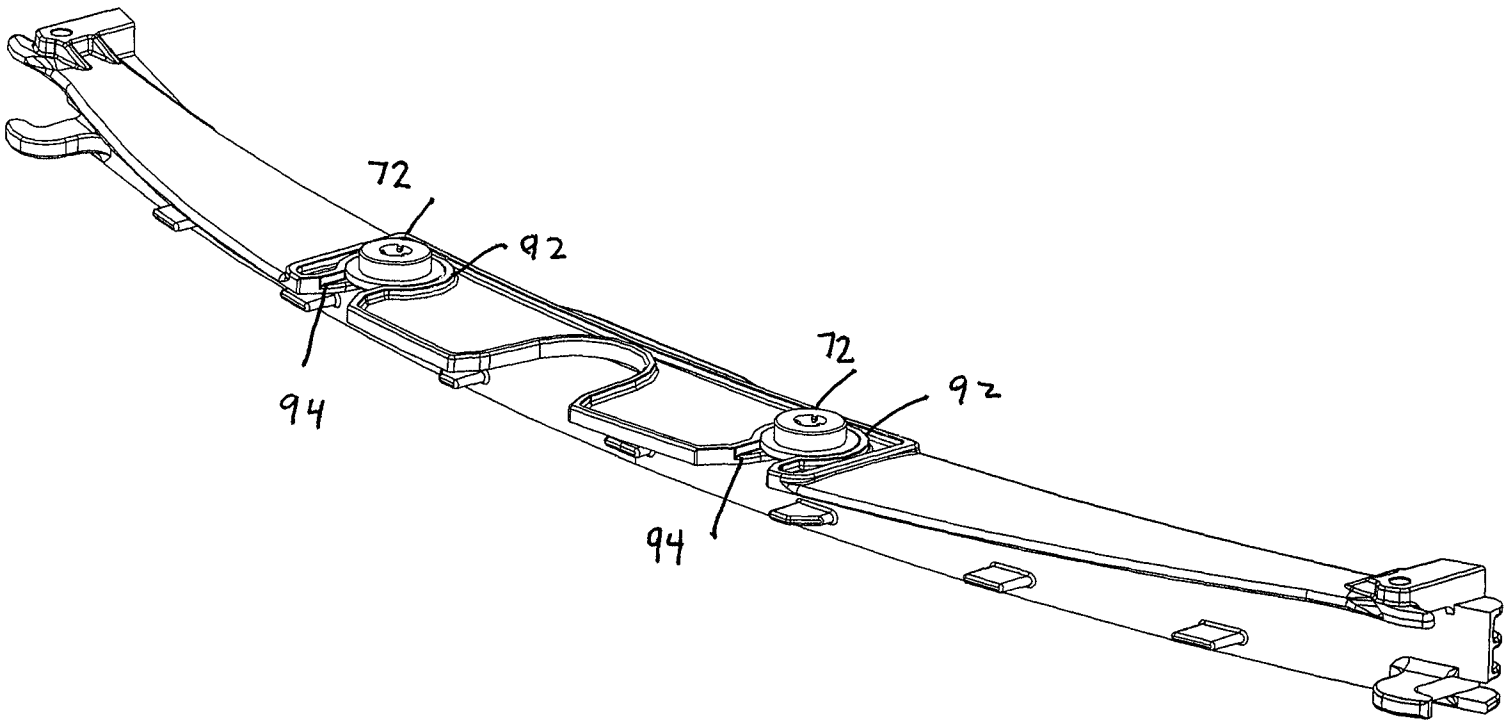
FIG. 12 is a perspective view of a portion of the squeegee assembly of FIG. 3.

Referring to FIG. 10, coupling receiving area 80 on squeegee mount 21 includes an enlarged section 82 and a channel portion 84, respectively, which cooperate with surfaces of the compliant bushings 72. Referring to FIGS. 11-12, coupling receiving area 90 on squeegee frame 50 includes an enlarged section 92 and a channel portion 94. The compliant bushings 72 include a head portion 100 and a neck portion 102 configured to cooperate with surfaces of the coupling receiving areas 80, 90 as described herein.

Figure 13:
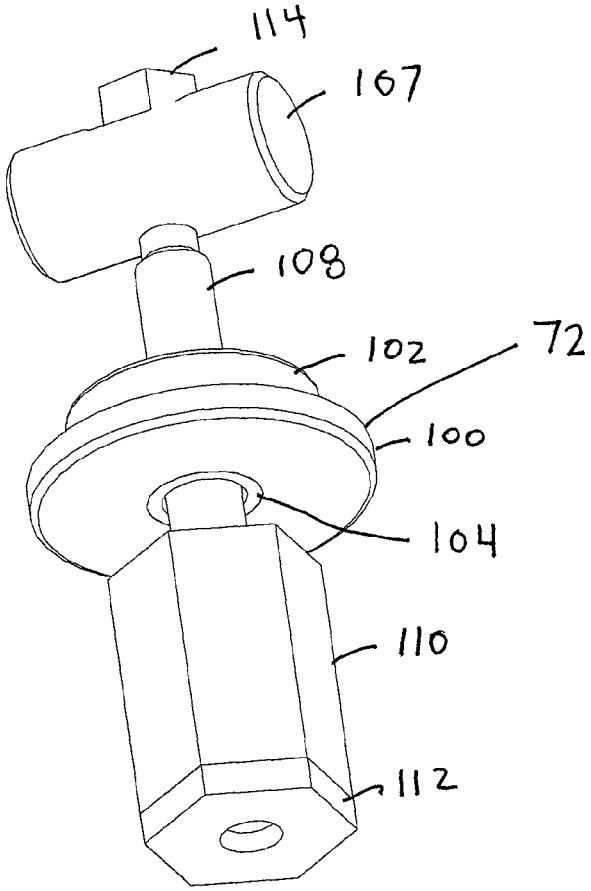
FIG. 13 is a perspective view of a compliant bushing assembly of the squeegee assembly of FIG. 3.
Figure 14:
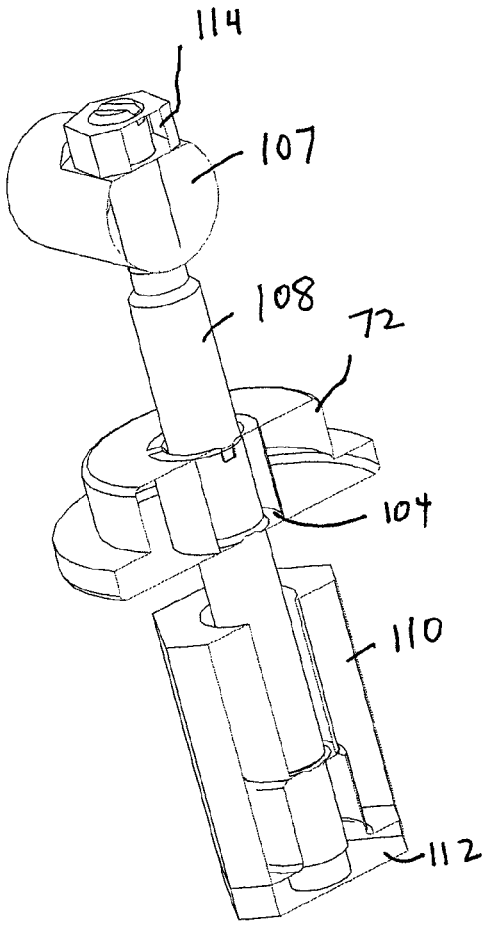
FIG. 14 is a cross-sectional view of the compliant bushing assembly of FIG. 13.

Referring to FIGS. 13-14, compliant bushings 72 include a rigid sleeve 104 which operatively limits the extent to which compliant bushings 72 can be compressed between squeegee mount 21 and frame 50. In limiting the amount of compression of compliant bushings 72, the sleeves 104 to some extent limit the amount of frictional resistive forces developed during a release operation.

Preferably, the releasable coupling assembly includes a pair of compliant bushings 72. However, it will be appreciated that other numbers of matching components may be utilized.

Figure 15:
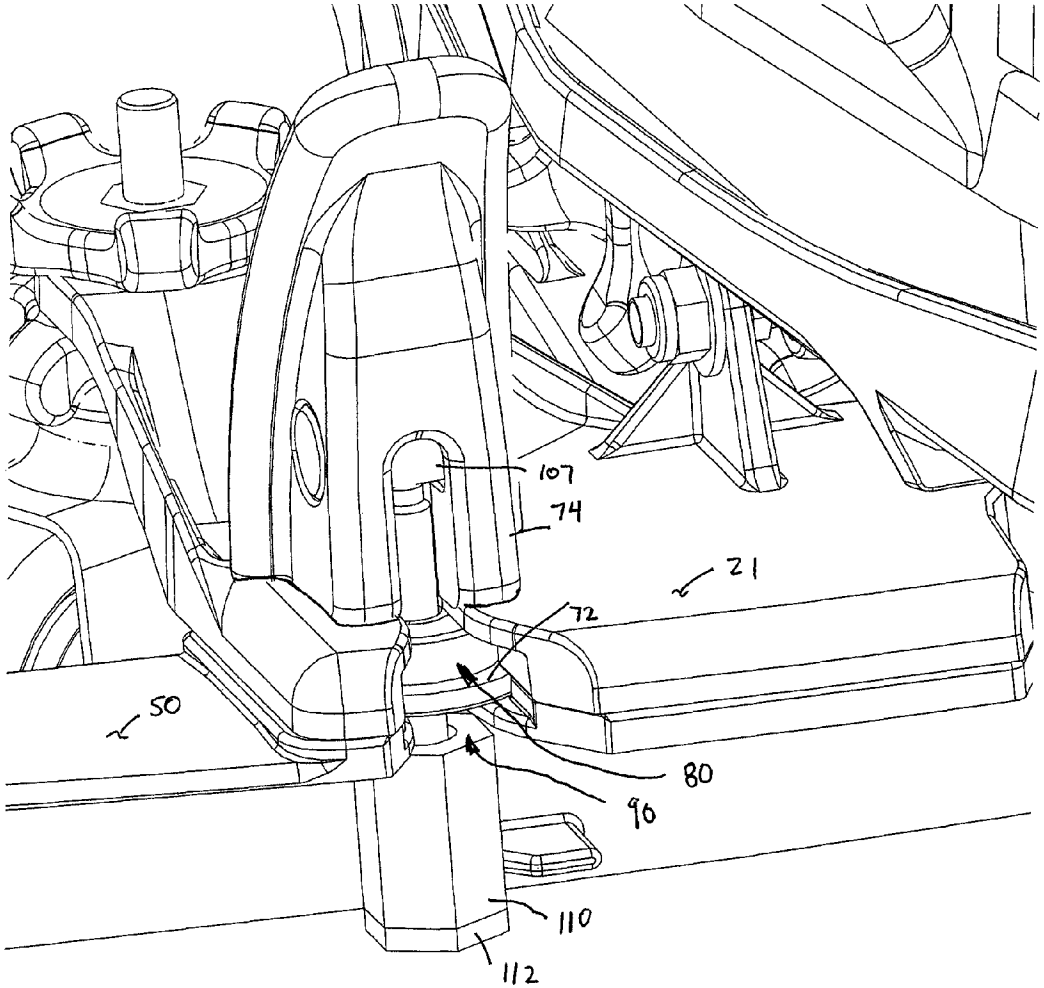
FIG. 15 is a detailed perspective view of a partial assembly of the squeegee assembly of FIG. 3.

Referring to FIG. 15, compliant bushings 72 are held between the squeegee frame 50 and squeegee mount 21 at the coupling receiving areas 80, 90 by fastening devices including over-center levers 74, which preferably may be tightened or loosened by hand, cross-pivot pin 107, pull rod 108, compliant/resilient spring 110 and retainer 112. A threaded fastener 114 secures lever 74 to pull rod 108. A variety of lever sizes would be appreciated by those skilled in the relative arts. The levers 74 may be rotated to compress the compliant bushings 72 between the squeegee frame 50 and the squeegee mount 21. Compression of compliant bushings 72 is limited by sleeves 104 thus controlling the degree of axial compression of the compliant bushings 72. Compliant spring 110 may be of a resilient material such as rubber, urethane, spring steel, etc. Compliant spring 110 provides an axial load on pull rod 108 when the squeegee assembly 20 is secured to squeegee mount 21.

In the position shown in FIG. 15, the over-center levers 74 are providing a compressive load on the compliant bushings 72. The load may be released by rotating the levers 74 approximately 90 degrees, in the direction shown in FIG. 16.

Figure 16:
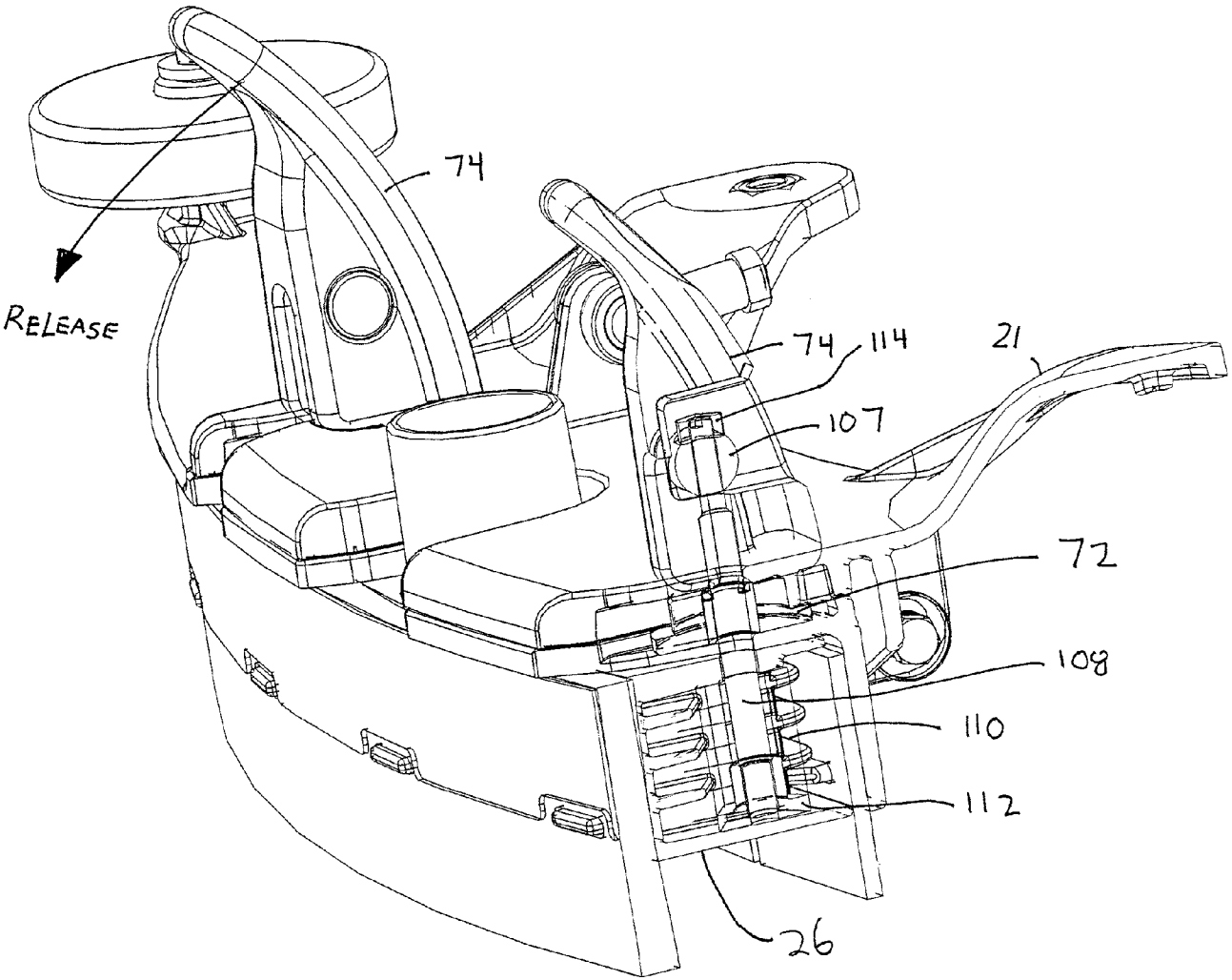
FIG. 16 is a cross-sectional perspective view of the detachable squeegee and squeegee mount of the squeegee assembly of FIG. 3.
Figure 17:
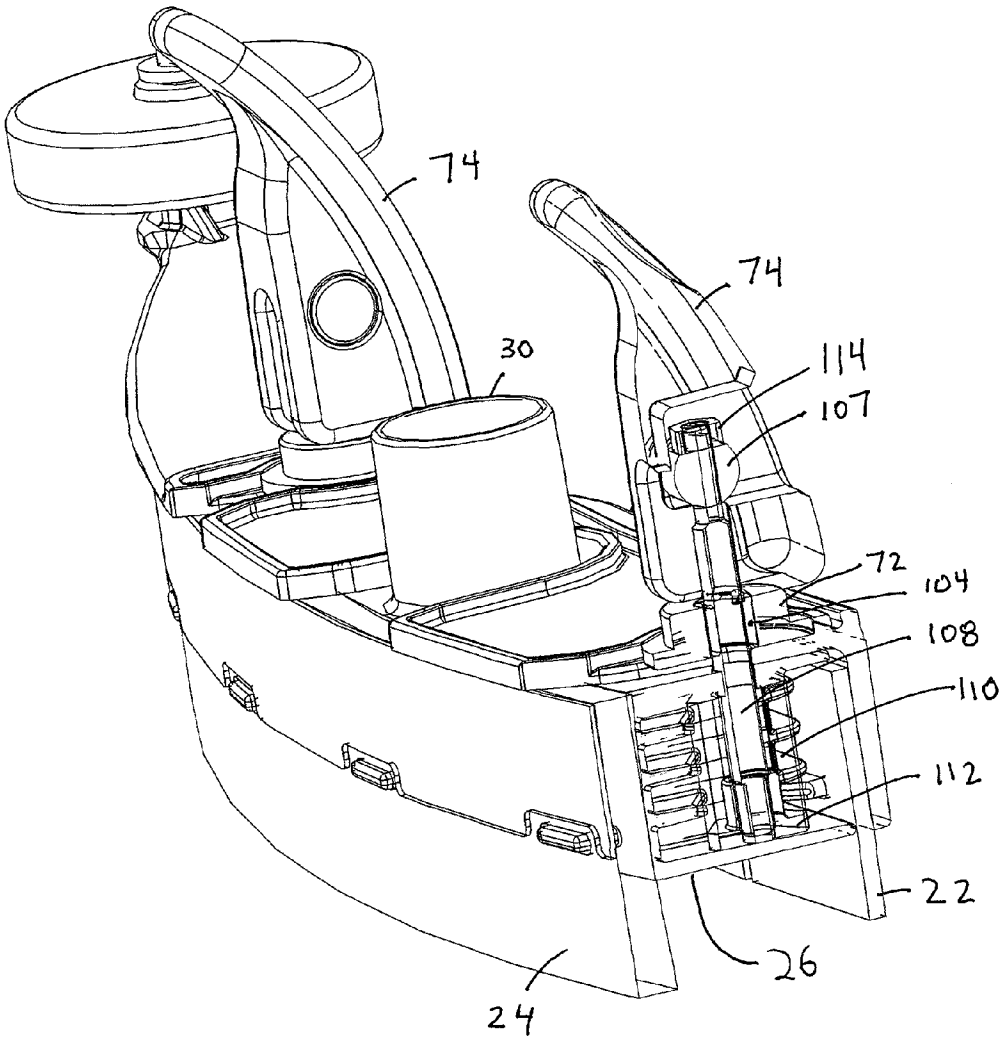
FIG. 17 is a cross-sectional perspective view of the squeegee depicted as detached from the squeegee mount of FIG. 16.

FIGS. 16-17 illustrate cross-sectional views of the squeegee assembly 20. In FIG. 16, squeegee assembly 20 is shown attached to squeegee mount 21, such as during normal operation of the surface maintenance machine. FIG. 17 depicts the squeegee assembly 20 removed from squeegee mount 21, such as after a release operation after the squeegee assembly contacts an obstacle during use of the surface maintenance machine.

As described herein, the compliant bushings 72 are deformable (along a substantially horizontal plane) during an obstruction contact condition in which the squeegee assembly 20 is released from the surface maintenance vehicle. During a release operation, the compliant bushings 72 are temporarily deformed as they pass along and through the channel portions 84, 94 of the coupling receiving areas 80, 90 prior to separation of the squeegee assembly 20 from the surface maintenance vehicle. During the release operation, the compliant bushings 72 provide both a resistive "shearing"-type force as the head portions 100 of the compliant bushings 72 pass through the channel portions 84, 94 of the coupling receiving areas 80, 90, and a frictional force developed between the upper, lower and side surfaces of the compliant bushings 72 in contact with surfaces of the coupling receiving areas.

Subsequent to a release operation, a squeegee assembly 20 may be reconnected to a surface maintenance vehicle by releasing the levers 74 a sufficient amount to allow compliant bushings 72 to be received into their respective coupling receiving areas 80, 90 and then tightening the levers 74 to an extent limited by sleeves 104.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A squeegee release mechanism for a floor surface maintenance machine comprising:

a squeegee mount connected to the surface maintenance machine;

a squeegee assembly having at least one squeegee blade;

a compliant bushing positioned between the squeegee mount and the squeegee assembly, said bushing exiting an opening during a squeegee release operation;

a movable pull rod attached to a resilient spring connected to the squeegee assembly, with said bull rod passing through the compliant bushing; and an over-center lever attached to an end of the pull rod and for compressing said compliant bushing between said squeegee mount and said squeegee assembly, and for compressing the resilient spring.

2. The squeegee assembly of claim 1 wherein the over-center lever includes a handle attached to the pull rod.

3. The squeegee assembly of claim 2 wherein the resilient spring is retained within a channel of a vacuum core structure of the squeegee assembly.

4. The squeegee assembly of claim 3 wherein the vacuum core structure includes a aperture through which said pull rod extends.

5. The squeegee assembly of claim 3 wherein the resilient spring is secured to an end of the pull rod via a retainer.

6. The squeegee assembly of claim 1 wherein the compliant bushing includes a bushing sleeve functioning to limit a degree of compression of said compliant bushing.

7. The squeegee assembly of claim 2 wherein the compliant bushing includes a bushing sleeve functioning to limit a degree of compression of said compliant bushing and the pull rod extends through said bushing sleeve.

8. A squeegee release mechanism for a floor surface maintenance machine comprising:

a squeegee mount connected to the surface maintenance machine;

a squeegee assembly having at least one squeegee blade and being releasably attached to the squeegee assembly via a plurality of compliant bushings held between the squeegee assembly and the squeegee mount; and a plurality of movable pull rods, wherein each pull rod is connected at one end to a resilient spring and connected to an over-center lever at the other end, and with each pull rod passing through one of the plurality of compliant bushings, and with each pull rod being actuated by said over-center lever to draw the squeegee assembly toward the squeegee mount, and wherein the plurality of pull rods move relative to the squeegee assembly when the over-center levers are actuated.

9. The squeegee assembly of claim 8 wherein the resilient spring is held within a vacuum core structure of the squeegee assembly.

10. The squeegee assembly of claim 8 wherein the compliant bushings include bushing sleeves functioning to limit a degree of compression of said compliant bushings.

11. The squeegee assembly of claim 10 wherein the pull rods extend through the bushing sleeves.

12. The squeegee assembly of claim 8 wherein each compliant bushing exits through an aperture defined in said squeegee mount or squeegee assembly or both during a release operation.

13. The squeegee assembly of claim 12 wherein each compliant bushing has a head portion and a neck portion.

14. The squeegee assembly of claim 13 wherein the head portion and neck portion of the compliant bushings are configured to cooperate with surfaces of coupling receiving areas on the squeegee assembly and the squeegee mount.

15. The squeegee assembly of claim 14 wherein the aperture extends into the coupling receiving areas of both the squeegee assembly and the squeegee mount, with the compliant bushing exiting the coupling receiving areas via the aperture.

16. A method of assembly for a squeegee blade assembly comprising:

providing a squeegee assembly having a squeegee blade connected thereto, and with an over-center lever connected to a movable pull rod and a resilient spring;

moving the over-center lever to an unloaded orientation;

inserting the squeegee frame into a squeegee mount; and moving the over-center lever into a loaded condition where a compliant bushing held between the squeegee assembly and the squeegee mount is compressed by said moving, and wherein the resilient spring is also compressed by said moving.

17. The method of claim 16 wherein said inserting includes passing a pair of compliant bushings into coupling receiving areas.

18. The method of claim 16 wherein said inserting includes centering the squeegee assembly via engagement between the compliant bushings and the coupling receiving areas.

19. The method of claim 16 wherein said moving the over-center lever results in compression of the resilient spring connected to said pull rod.

20. The method of claim 16 wherein compression of said compliant bushing is limited by a bushing sleeve within the compliant bushing, with said pull rod extending through said bushing sleeve.

* * * * *